US011365712B2

(12) United States Patent
Montgomery et al.

(10) Patent No.: US 11,365,712 B2
(45) Date of Patent: Jun. 21, 2022

(54) CONTROL SYSTEM FOR A DEDICATED EXHAUST GAS RECIRCULATION ENGINE

(71) Applicant: Caterpillar Inc., Peoria, IL (US)

(72) Inventors: David Todd Montgomery, Edelstein, IL (US); Greg Hampson, Boulder, CO (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/949,742

(22) Filed: Nov. 12, 2020

(65) Prior Publication Data

US 2021/0148323 A1 May 20, 2021

Related U.S. Application Data

(60) Provisional application No. 62/937,671, filed on Nov. 19, 2019.

(51) Int. Cl.

| | |
|---|---|
| ***F02M 26/43*** | (2016.01) |
| ***F02D 35/02*** | (2006.01) |
| ***F02D 41/40*** | (2006.01) |
| ***F02P 5/04*** | (2006.01) |
| ***F02P 5/15*** | (2006.01) |

(52) U.S. Cl.

CPC ..... *F02P 5/045* (2013.01); *F02D 35/028* (2013.01); *F02D 41/401* (2013.01); *F02P 5/15* (2013.01)

(58) Field of Classification Search

CPC .... F02D 35/023; F02D 35/028; F02D 41/401; F02M 26/43; F02M 26/44; F02P 5/153

USPC ..... 701/105; 123/305, 406.41, 435, 568.11, 123/568.21

See application file for complete search history.

(56) References Cited

U.S. PATENT DOCUMENTS

| | | | | |
|---|---|---|---|---|
| 7,231,905 | B1 * | 6/2007 | Haskara | F02D 35/028 123/435 |
| 8,944,034 | B2 | 2/2015 | Gingrich et al. | |
| 9,032,940 | B2 | 5/2015 | Dane et al. | |
| 9,255,552 | B2 | 2/2016 | Goetzke et al. | |
| 9,534,517 | B2 | 1/2017 | Styles et al. | |
| 9,534,567 | B2 | 1/2017 | Ulrey et al. | |
| 2017/0022911 | A1 * | 1/2017 | Kitagawa | F02D 41/28 |
| 2017/0314499 | A1 * | 11/2017 | Urano | F02D 35/028 |
| 2018/0030909 | A1 * | 2/2018 | Kitagawa | F02D 35/028 |

(Continued)

FOREIGN PATENT DOCUMENTS

WO 2014/005127 A2 1/2014

*Primary Examiner* — Erick R Solis

(74) *Attorney, Agent, or Firm* — Harrity & Harrity LLP

(57) ABSTRACT

A controller for a dedicated exhaust gas recirculation (D-EGR) engine is disclosed. The controller may receive a plurality of cylinder pressure signals, each of which is associated with a respective cylinder in a plurality of cylinders of the D-EGR engine. The plurality of cylinders includes at least one donor cylinder and a set of non-donor cylinders. The controller may receive a crankshaft angle signal associated with a crankshaft of the D-EGR engine. The controller may selectively adjust ignition timing of a cylinder, of the plurality of cylinders, based on the crankshaft angle signal and a cylinder pressure signal, of the plurality of cylinder pressure signals, associated with the cylinder; or a fuel rate of the at least one donor cylinder based on the crankshaft angle signal and a set of cylinder pressure signals, of the plurality of cylinder pressure signals, associated with the set of non-donor cylinders.

20 Claims, 3 Drawing Sheets

(56) References Cited

U.S. PATENT DOCUMENTS

| | | | | |
|---|---|---|---|---|
| 2018/0238247 | A1* | 8/2018 | Gukelberger | F02M 26/43 |
| 2019/0368460 | A1* | 12/2019 | Urano | F02P 5/045 |
| 2020/0318570 | A1* | 10/2020 | Hampson | F02D 35/028 |

* cited by examiner

CONTROL SYSTEM FOR A DEDICATED EXHAUST GAS RECIRCULATION ENGINE

CROSS-REFERENCE TO RELATED APPLICATION

This application claims priority to U.S. Provisional Patent Application No. 62/937,671, filed on Nov. 19, 2019, entitled "CONTROL SYSTEM FOR A DEDICATED EXHAUST GAS RECIRCULATION ENGINE," which is hereby expressly incorporated by reference herein.

TECHNICAL FIELD

The present disclosure relates generally to a dedicated exhaust gas recirculation (D-EGR) engine and, more particularly, to a system for controlling ignition timing of a cylinder of the D-EGR engine and/or a fuel rate of a donor cylinder of the D-EGR engine.

BACKGROUND

In operation, an internal combustion engine (e.g., a diesel engine or a gasoline engine) burns a mixture of air and fuel within cylinders of the engine in order to generate mechanical power. The burning of the air-fuel mixture produces exhaust gas that can include air pollutants, such as unburned fuel, particulate matter (e.g., soot), and potentially harmful gases (e.g., nitrous oxide, carbon monoxide). An applicable emissions standard may dictate an amount and/or a type of pollutant that the engine is permitted to discharge.

Some engines include an exhaust gas recirculation (EGR) system in order to reduce pollutants in exhaust gas produced by the engine. An EGR system is a system designed to recirculate exhaust gas through combustion chambers of the engine by mixing at least some of the exhaust gas with fresh air entering the combustion chambers. This exhaust-air mixture can reduce the amount of pollutants produced as a result of combustion, as well as reduce engine knock, throttling losses, in-cylinder heat losses, and/or the like.

Some EGR systems are configured with one or more cylinders that are dedicated to recirculating exhaust gas to the combustion chambers of the engine. Such a system is referred to as a dedicated EGR (D-EGR) system. A cylinder in a D-EGR system that is dedicated to recirculating exhaust gas is referred to as a donor cylinder, while a cylinder that does not recirculate exhaust gas in the D-EGR system is referred to as a non-donor cylinder. In a typical D-EGR system, all exhaust gas from the donor cylinders is recirculated to the combustion chambers, while exhaust gas from the non-donor cylinders flows through an exhaust system of the engine (e.g., for eventual release into the atmosphere). In practice, the donor cylinders allow a substantially fixed amount of exhaust gas to be recirculated under a given operating condition.

One attempt associated with improving performance of a D-EGR engine is disclosed in U.S. Pat. No. 9,534,517 that issued to Ford Global Technologies, LLC, on Jan. 3, 2017 ("the '517 patent"). In particular, the '517 patent discloses a method to decrease exhaust blowdown interference between non-donor cylinders of a D-EGR engine and to evenly space exhaust pulses to a turbine associated with the D-EGR engine. However, while the '517 patent may address the issue of exhaust blown down interference and/or unevenly spaced exhaust pulses, the '517 does not address control of ignition timing or fueling in association with improving performance of a D-EGR engine.

The control system of the present disclosure solves one or more of the problems set forth above and/or other problems in the art.

SUMMARY

According to some implementations, a method may include: receiving, by a device, a cylinder pressure signal associated with a cylinder in a D-EGR engine; receiving, by the device, a crankshaft angle signal associated with a crankshaft of the D-EGR engine; determining, by the device and based on the cylinder pressure signal and the crankshaft angle signal, an angular position of the crankshaft at a time of a particular amount of fuel burn in the cylinder; determining, by the device, whether the angular position matches a particular angular position of the crankshaft at the time of the particular amount of fuel burn in the cylinder; and selectively adjusting, by the device, ignition timing of the cylinder based on whether the angular position matches the particular angular position.

According to some implementations, a method may include: receiving, by a device, a set of cylinder pressure signals each of which is associated with a respective non-donor cylinder in a set of non-donor cylinders of a D-EGR engine; receiving, by the device, a crankshaft angle signal associated with a crankshaft of the D-EGR engine; determining, by the device and based on the set of cylinder pressure signals and the crankshaft angle signal, a combustion time associated with the set of non-donor cylinders; determining, by the device, whether the combustion time matches a particular combustion time associated with the set of non-donor cylinders; and selectively adjusting, by the device, a fuel rate of a donor cylinder of the D-EGR engine based on whether the combustion time matches the particular combustion time.

According to some implementations, an engine system may include a D-EGR engine and a controller, communicatively coupled with the D-EGR engine, to: receive a plurality of cylinder pressure signals each of which is associated with a respective cylinder in a plurality of cylinders of the D-EGR engine, wherein the plurality of cylinders includes at least one donor cylinder and a set of non-donor cylinders; receive a crankshaft angle signal associated with a crankshaft of the D-EGR engine; and selectively adjust at least one of: ignition timing of a cylinder, of the plurality of cylinders, based on the crankshaft angle signal and a cylinder pressure signal, of the plurality of cylinder pressure signals, associated with the cylinder; or a fuel rate of the at least one donor cylinder based on the crankshaft angle signal and a set of cylinder pressure signals, of the plurality of cylinder pressure signals, associated with the set of non-donor cylinders.

DETAILED DESCRIPTION

This disclosure relates to a control system for a D-EGR engine. The control system described has applicability to any internal combustion engine utilizing a D-EGR system, such as a diesel engine with a D-EGR system or a gasoline engine with a D-EGR system. The control system for the D-EGR engine may be utilized in any machine with a D-EGR engine, such as any machine that performs an operation associated with an industry (e.g., mining, construction, farming, transportation, and/or the like the like).

Figure 1:
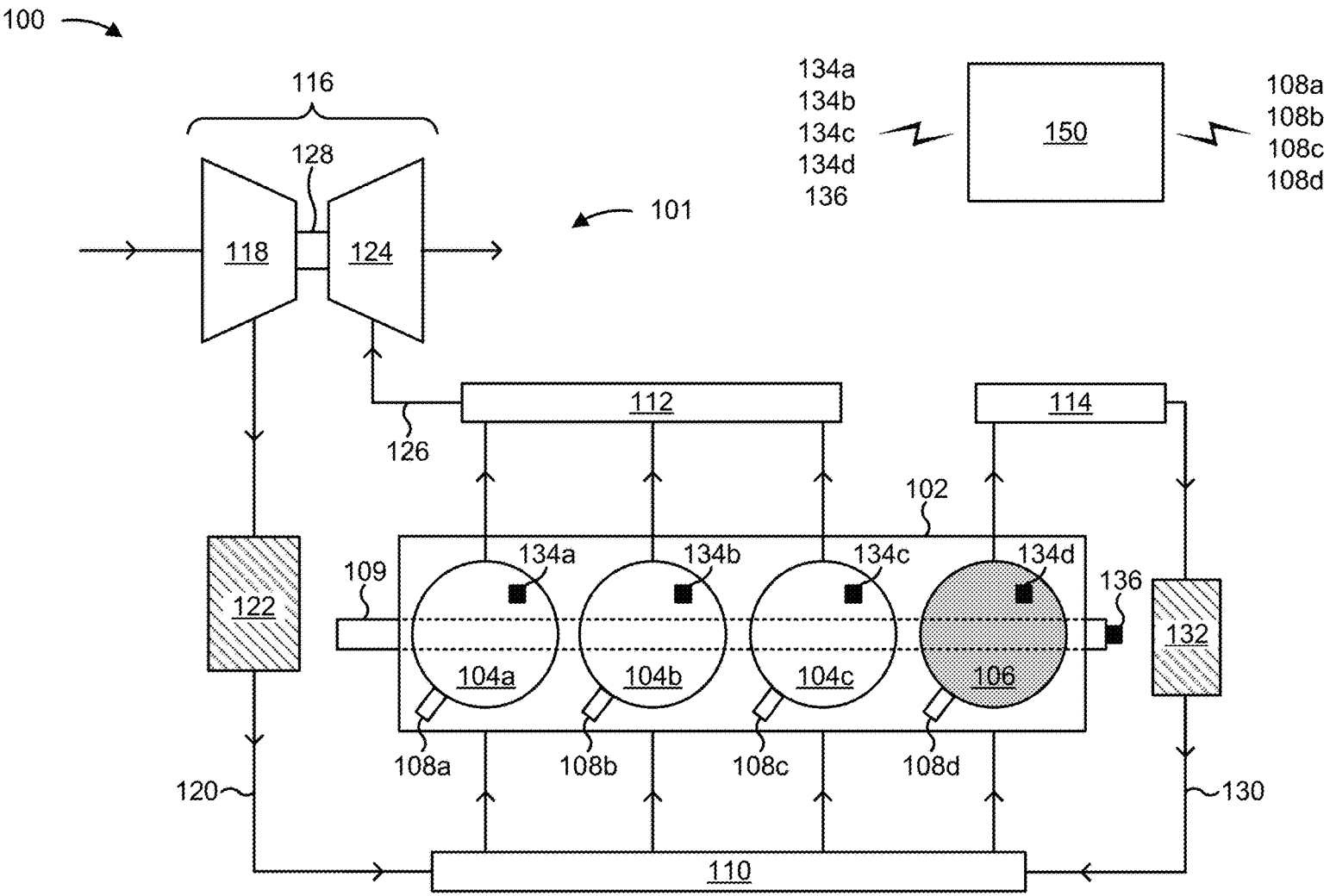
FIG. 1 is a diagram of an example engine system including a dedicated exhaust gas recirculation (D-EGR) engine and a control device, as described herein.

FIG. 1 is a diagram of an example engine system 100 including a dedicated exhaust gas recirculation (D-EGR) engine 101 and a control device 150.

D-EGR engine 101 may be an internal combustion engine (e.g., a diesel engine, a gas engine, and/or the like). D-EGR engine 101 may be a two-stroke engine, a four-stroke engine, or the like, and may comprise any number of combustion chambers. The combustion chambers of D-EGR engine 101 may be disposed in an in-line configuration, in an opposing-piston configuration, or in any other suitable configuration.

As shown in FIG. 1, D-EGR engine 101 may include a cylinder bank 102 that includes a set of non-donor cylinders 104 (e.g., 104*a*, 104*b*, and 104*c*), and a donor cylinder 106. Notably, while FIG. 1 depicts D-EGR engine 101 as including a single cylinder bank 102 comprising three non-donor cylinders 104 and a single donor cylinder 106, D-EGR engine 101 may include one or more additional cylinder banks 102, a different number of non-donor cylinders 104 in cylinder bank 102, and/or one or more additional donor cylinders 106 in cylinder bank. As shown, fuel injectors 108 may be arranged to inject fuel into cylinders of D-EGR engine 101. For example, fuel injector 108*a* may be arranged to inject fuel into non-donor cylinder 104*a*, fuel injector 108*b* may be arranged to inject fuel into non-donor cylinder 104*b*, fuel injector 108*c* may be arranged to inject fuel into non-donor cylinder 104*c*, and fuel injector 108*d* may be arranged to inject fuel into donor cylinder 106.

Non-donor cylinder 104 is an engine cylinder arranged such that all exhaust gas is discharged to the atmosphere, and which does not donate any exhaust gas for recirculation through cylinders of D-EGR engine 101.

Donor cylinder 106 is an engine cylinder arranged to donate all exhaust gas generated by donor cylinder 106 for recirculation through one or more cylinders (e.g., non-donor cylinders 104 and donor cylinder 106) of D-EGR engine 101.

As further shown, D-EGR engine 101 may include a crankshaft 109. Crankshaft 109 is mechanically connected to pistons of non-donor cylinders 104 and donor cylinder 106 in order to convert reciprocating motion into rotary motion.

D-EGR engine 101 may further include components associated with introducing air into and discharge exhaust gas from non-donor cylinders 104 and donor cylinder 106. For example, D-EGR engine 101 may include turbocharger 116, intake manifold 110, first exhaust manifold 112, and second exhaust manifold 114.

Turbocharger 116 may include compressor 118, which may compress air and direct the compressed air via passageway 120 and cooling element 122 to intake manifold 110. Compressor 118 may be driven by turbine 124, which may be propelled by exhaust gas flowing out from first exhaust manifold via passageway 126. Exhaust gas may be discharged from turbine 124 to the atmosphere. Turbine 124 may be directly and mechanically connected to compressor 118 by shaft 128 to form turbocharger 116. As exhaust gas exiting exhaust manifold 112 moves through and expands in turbine 124, turbine 124 may rotate and drive compressor 118 to pressurize and direct air to intake manifold 110.

Intake manifold 110 may receive compressed air from compressor 118 via passageway 120 and cooling element 122. Intake manifold 110 may distribute the compressed air into non-donor cylinders 104 and donor cylinder 106 in cylinder bank 102.

First exhaust manifold 112 may receive exhaust gas generated in non-donor cylinders 104 in cylinder bank 102. Exhaust gas from first exhaust manifold 112 may be directed to turbocharger 116 via passageway 126 before being discharged into the atmosphere.

Second exhaust manifold 114 may receive exhaust from donor cylinder 106 and recirculate the exhaust gas via passageway 130 and cooling element 132 to intake manifold 110. Second exhaust manifold 114 may be separate from first exhaust manifold 112 (e.g., such that second exhaust manifold 114 is disconnected or isolated from first exhaust manifold 112). Thus, there may be no passageway connecting first exhaust manifold 112 and second exhaust manifold 114.

As illustrated in FIG. 1, all exhaust gas generated by donor cylinder 106 is recirculated via second exhaust manifold 114 and passageway 130 into intake manifold 110. In the example shown in FIG. 1, exhaust from a single donor cylinder 106 is recirculated into four cylinders—three non-donor cylinders 104 and donor cylinder 106—providing an EGR rate of 25%. Of course, the EGR rate of D-EGR engine 101 can be different in some implementations, depending on the number of cylinder banks 102, the number of non-donor cylinders 104 included in each cylinder bank 102, and the number of donor cylinders 106 included in each cylinder bank 102.

Engine system 100 may also include a set of components associated with monitoring and controlling operation of D-EGR engine 101. For example, as shown, engine system 100 may include a set of pressure sensors 134, an angle sensor 136, and a control device 150.

Pressure sensor 134 is a device capable of sensing an amount of pressure within a given cylinder of D-EGR engine 101, and providing a cylinder pressure signal indicative of the sensed amount of pressure. As shown, pressure sensor 134*a* may be arranged to provide a cylinder pressure signal associated with non-donor cylinder 104*a*, pressure sensor 134*b* may be arranged to provide a cylinder pressure signal associated with non-donor cylinder 104*b*, pressure sensor 134*c* may be arranged to provide a cylinder pressure signal associated with non-donor cylinder 104*c*, and pressure sensor 134*d* may be arranged to provide a cylinder pressure signal associated with donor cylinder 106.

Angle sensor 136 is a device capable of sensing angular position of crankshaft 109, and providing a crankshaft angle signal indicative of the sensed angular position. As shown, angle sensor 136 can be arranged at or near an end of crankshaft 109.

Control device 150 is a device (e.g., a controller) capable of controlling ignition timing of one or more cylinders of D-EGR engine 101 (e.g., non-donor cylinder 104 and/or donor cylinder 106) and/or fueling of donor cylinder 106, as described herein. As indicated in FIG. 1, control device 150 may be communicatively coupled to pressure sensors 134 and angle sensor 136 (e.g., such that control device 150 can receive senor signals provided by pressure sensors 134 and angle sensor 136) and fuel injectors 108 (e.g., such that control device 150 can provide control signals to fuel injectors 108). Details regarding control of ignition timing of cylinders of D-EGR engine 101 are described in association with FIG. 2, while details regarding control of fueling of donor cylinder 106 are described in association with FIG. 3.

Control device 150 is implemented as a processor, such as a central processing unit (CPU), a graphics processing unit (GPU), an accelerated processing unit (APU), a microprocessor, a microcontroller, a digital signal processor (DSP), a field-programmable gate array (FPGA), an application-specific integrated circuit (ASIC), or another type of processing component. The processor is implemented in hardware, firmware, and/or a combination of hardware and software. Control device 150 includes one or more processors capable of being programmed to perform a function.

Control device 150 may include a memory, such as a random-access memory (RAM), a read only memory (ROM), and/or another type of dynamic or static storage device (e.g., a flash memory, a magnetic memory, and/or an optical memory) that may store information and/or instructions for use by control device 150. Control device 150 may include a memory (e.g., a non-transitory computer-readable medium) capable of storing instructions, that when executed, cause the processor to perform one or more processes and/or methods described herein. Control device 150 executes the instructions to perform various functions as described herein. Control device 150 may include any appropriate type of communication and control system configured to perform functions described herein. Further, control device 150 may also control another system of engine 100 and/or machine in which engine 100 is installed.

Control device 150 includes an input component that permits information to be input to the system, such as by a device associated with another system, a controller, via user input, and/or the like. Control device 150 may also include an output component that provides output information (e.g., to a device associated with another system, to a controller, and/or the like).

Control device 150 also includes a communication interface that includes a transceiver-like component (e.g., a transceiver and/or a separate receiver and transmitter) that enables communication with other devices, such as via a wired connection, a wireless connection, or a combination of wired and wireless connections. For example, the communication interface may include an Ethernet interface, an optical interface, a coaxial interface, an infrared interface, a radio frequency (RF) interface, a universal serial bus (USB) interface, a Wi-Fi interface, a cellular network interface, or the like.

As indicated above, FIG. 1 is provided as an example. Other examples differ from what is described in connection with FIG. 1. In practice, there may be additional components, fewer components, different components, a different number of components, or differently arranged components than those shown in FIG. 1. Furthermore, two or more components shown in FIG. 1 may be implemented within a single component, or a single component shown in FIG. 1 may be implemented as multiple, distributed components. A set of components (e.g., one or more components) described in association with FIG. 1 may perform one or more functions described as being performed by another set of components of FIG. 1.

Figure 2:
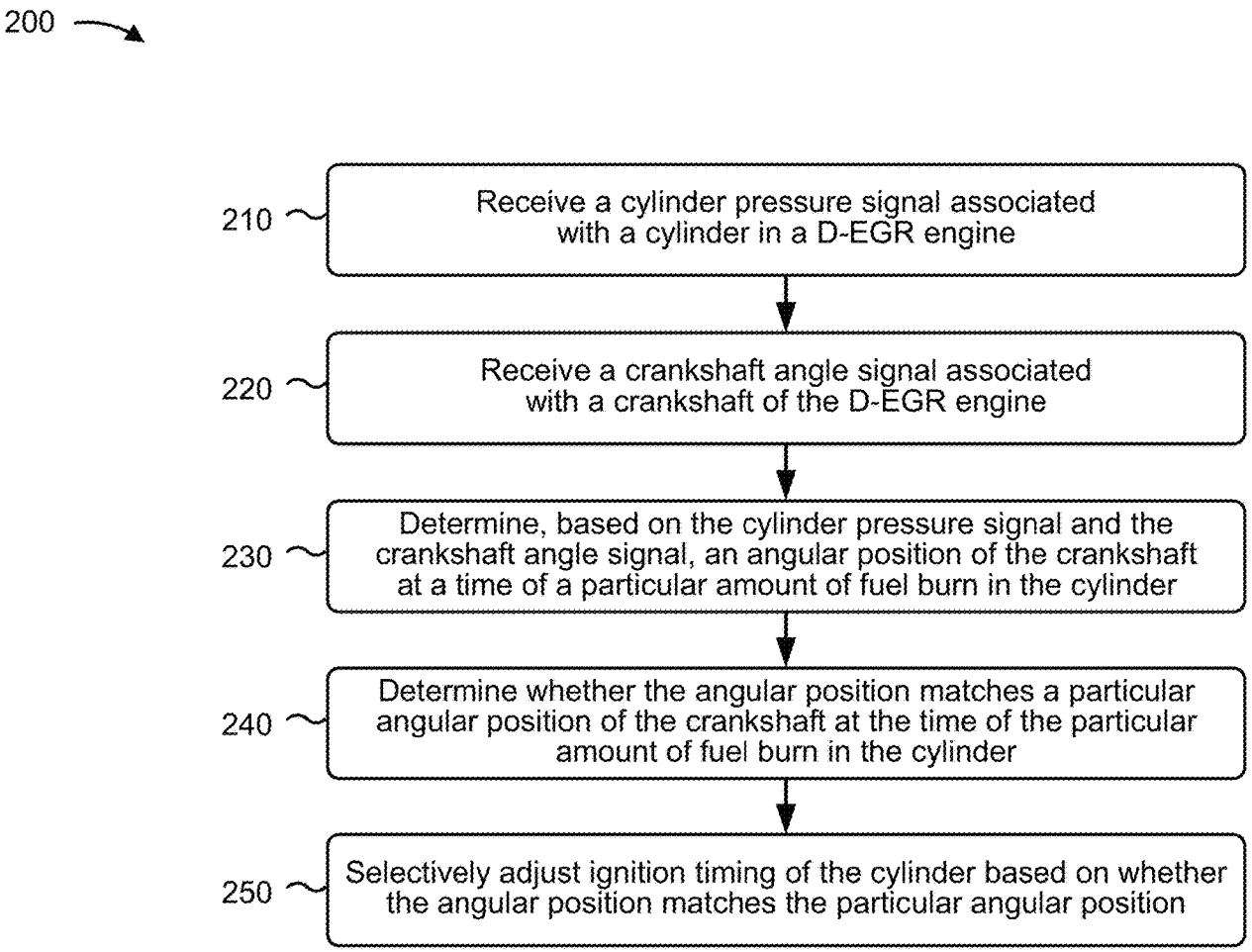
FIG. 2 is a flow chart of an example process for controlling ignition timing of one or more cylinders of a D-EGR engine, as described herein.

FIG. 2 is a flow chart of an example process 200 for controlling ignition timing of one or more cylinders of a D-EGR engine. One or more process blocks of FIG. 2 may be performed by a device associated with an engine, such as control device 150 associated with D-EGR engine 101. Notably, while example process 200 is described in the context of controlling ignition timing of a single cylinder of D-EGR engine 101, example process 200 may be performed for each cylinder of D-EGR engine 101. In other words, example process 200 may be performed in association with controlling each non-donor cylinder 104 and donor cylinder 106 of D-EGR engine 101.

As shown in FIG. 2, process 200 may include receiving a cylinder pressure signal associated with a cylinder in a D-EGR engine (block 210). For example, control device 150 may (e.g., using a processor, an input component, a communication interface, and/or the like) receive a cylinder pressure signal associated with a cylinder in D-EGR engine 101. As indicated above, the cylinder can be a non-donor cylinder 104 of D-EGR engine 101 or a donor cylinder 106 of D-EGR engine 101.

The cylinder pressure signal is a signal indicative of an amount of pressure within the cylinder over a given period of time (e.g., a particular set of engine cycles). Control device 150 may receive the cylinder pressure signal from pressure sensor 134 associated with the cylinder. For example, when the cylinder is non-donor cylinder 104*a*, control device 150 may receive a cylinder pressure signal from pressure sensor 134*a* associated with non-donor cylinder 104*a*. As another example, when the cylinder is donor cylinder 106, control device 150 may receive a cylinder pressure signal from pressure sensor 134*d* associated with donor cylinder 106.

Control device 150 may receive the cylinder pressure signal based on requesting the cylinder pressure signal from pressure sensor 134. Additionally, or alternatively, control device 150 may automatically receive the cylinder pressure signal from pressure sensor 134 (e.g., when pressure sensor 134 is configured to automatically provide the cylinder pressure signal on a periodic basis or continuously).

As further shown in FIG. 2, process 200 may include receiving a crankshaft angle signal associated with a crankshaft of the D-EGR engine (block 220). For example, control device 150 may (e.g., using a processor, an input component, a communication interface, and/or the like) receive a crankshaft angle signal associated with crankshaft 109 of D-EGR engine 101.

The crankshaft angle signal is a signal indicative of an angular position of crankshaft 109 over a given period of time (e.g., over a particular set of engine cycles). The angular position of crankshaft 109 may be defined as angular position relative to a reference angular position. Control device 150 may receive the crankshaft angle signal from angle sensor 136 associated with crankshaft 109.

Control device 150 may receive the crankshaft angle signal based on requesting the crankshaft angle signal from angle sensor 136. Additionally, or alternatively, control device 150 may automatically receive the crankshaft angle signal from angle sensor 136 (e.g., when angle sensor 136 is configured to automatically provide the crankshaft angle signal on a periodic basis or continuously).

As further shown in FIG. 2, process 200 may include determining, based on the cylinder pressure signal and the crankshaft angle signal, an angular position of the crankshaft at a time of a particular amount of fuel burn in the cylinder (block 230). For example, control device 150 may (e.g., using a processor, a memory, and/or the like) determine, based on the cylinder pressure signal and the crankshaft angle signal, an angular position of crankshaft 109 at a time of a particular amount of fuel burn in the cylinder.

The particular amount of fuel burn in the cylinder may be approximately 50% fuel burn in the cylinder. In other words, control device 150 may be configured to determine an angular position of crankshaft 109 at a time of approximately 50% fuel burn in the cylinder (i.e., a time at which approximately 50% of the fuel in the cylinder has been burned). The angular position of crankshaft 109 at 50% fuel burn is referred to as CA50. Alternatively, the particular amount of fuel burn in the cylinder may be another amount of fuel burn (e.g., 45% fuel burn in the cylinder, 55% fuel burn in the cylinder, and/or the like).

Control device 150 may determine the angular position at the time of the particular amount of fuel burn (e.g., CA50) by calculating a heat release rate (e.g., an apparent heat release rate (AHRR)) from the cylinder pressure signal and the crankshaft angle signal (using techniques known in the art), and then identifying, based on the heat release rate, an angular position of crankshaft 109 at the time of the particular amount of fuel burn. For example, control device 150 may calculate an AHRR based on the cylinder pressure signal and the crankshaft angle signal, and may identify CA50 based on the calculated AHRR.

As further shown in FIG. 2, process 200 may include determining whether the angular position matches a particular angular position of the crankshaft at the time of the particular amount of fuel burn in the cylinder (block 240). For example, control device 150 may (e.g., using a processor, a memory, and/or the like) determine whether the angular position matches a particular angular position of crankshaft 109 at the time of the particular amount of fuel burn in the cylinder.

The particular angular position of crankshaft 109 may be an expected, desired, or preferred angular position of crankshaft 109 at the time of the particular amount of fuel burn in the cylinder. For example, the particular angular position of crankshaft 109 may be a desired angular position of crankshaft 109 at the time of 50% fuel burn in the cylinder (e.g., a desired CA50). The particular angular position may depend on the cylinder (i.e., the particular angular positions may vary among cylinders of D-EGR engine 101). Additionally, or alternatively, the particular angular position may depend on an engine speed and/or an engine load of D-EGR engine 101.

Control device 150 may determine information that identifies the particular angular position based on information stored or accessible by control device 150. For example, control device 150 may store a lookup table that includes information that identifies a particular angular position for each cylinder of D-EGR engine 101 at the time of the particular amount of fuel burn (e.g., for a given range of engine speeds and/or range of engine loads).

Control device 150 may determine whether the angular position of crankshaft 109 at the particular time matches the particular angular position based on a difference between the angular position and the particular angular position. For example, control device 150 may calculate a difference between the angular position of crankshaft 109 at the time of 50% fuel burn and a desired angular position at the time of 50% fuel burn, and may determine whether the difference satisfies a threshold. Here, if the difference satisfies the threshold (e.g., if the difference is less than or equal to a maximum allowable difference), then control device 150 may determine that the angular position of crankshaft 109 at the time of 50% fuel burn matches the desired angular position. Alternatively, if the difference does not satisfy the threshold (e.g., if the difference is greater than the maximum allowable difference), then control device 150 may determine that the angular position of crankshaft 109 at the time of 50% fuel burn does not match the desired angular position at the time of 50% fuel burn.

As further shown in FIG. 2, process 200 may include selectively adjusting ignition timing of the cylinder based on whether the angular position matches the particular angular position (block 250). For example, control device 150 may (e.g., using a processor, a memory, an output component, a communication interface, and/or the like) selectively adjust ignition timing of the cylinder based on whether the angular position matches the particular angular position.

When control device 150 determines that the angular position does not match the particular angular position, control device 150 may determine whether the angular position at the time of the particular amount of fuel burn is after the particular angular position or before the particular angular position. For example, control device 150 determine that the angular position of crankshaft 109 at the time of 50% fuel burn does not match a desired angular position at the time of 50% fuel burn, as described above. Here, control device 150 may determine whether the angular position of crankshaft 109 at the time of 50% fuel burn is after the desired angular position (e.g., whether crankshaft 109 has passed the desired angular position at the time of 50% fuel burn) or before the desired angular position (e.g., whether crankshaft 109 has not reached the desired angular position at the time of 50% fuel burn).

When control device 150 determines that the angular position is after the desired angular position, control device 150 may advance the ignition timing of the cylinder (e.g., in order to cause the time of 50% fuel burn to be comparatively earlier in a given set of engine cycles). Conversely, when control device 150 determines that the angular position is before the desired angular position, control device 150 may retard the ignition timing of the cylinder (e.g., in order to cause the time of 50% fuel burn to be comparatively later in a given set of engine cycles).

Control device 150 may adjust (e.g., advance or retard) the ignition timing of the cylinder by sending a control signal to fuel injector 108 associated with the cylinder. Control device 150 may adjust the ignition timing by an incremental amount of time, by a default amount of time, or by an amount of time determined based on the difference between the angular position and the desired angular position (e.g., based on a lookup table that identifies ignition timing adjustments for differences between the angular position and the particular angular position).

When control device 150 determines that the angular position matches the particular angular position, the selective adjustment by control device 150 may include maintaining the ignition timing of the cylinder (e.g., such that the ignition timing of the cylinder is not adjusted).

Control device 150 may perform process 200 for one or more cylinders of D-EGR engine 101. For example, control device 150 may perform process 200 for one or more non-donor cylinders 104 and/or one or more donor cylinders 106 of D-EGR engine 101 (e.g., concurrently, in a particular order, in a random order, and/or the like). In this way, control device 150 may control ignition timing of a cylinder (e.g., non-donor cylinder 104 or donor cylinder 106) of a D-EGR engine (e.g., D-EGR engine 101) based on cylinder pressure within the cylinder.

Although FIG. 2 shows example blocks of process 200, process 200 may include additional blocks, fewer blocks, different blocks, or differently arranged blocks than those depicted in FIG. 2. Additionally, or alternatively, two or more of the blocks of process 200 may be performed in parallel.

Figure 3:
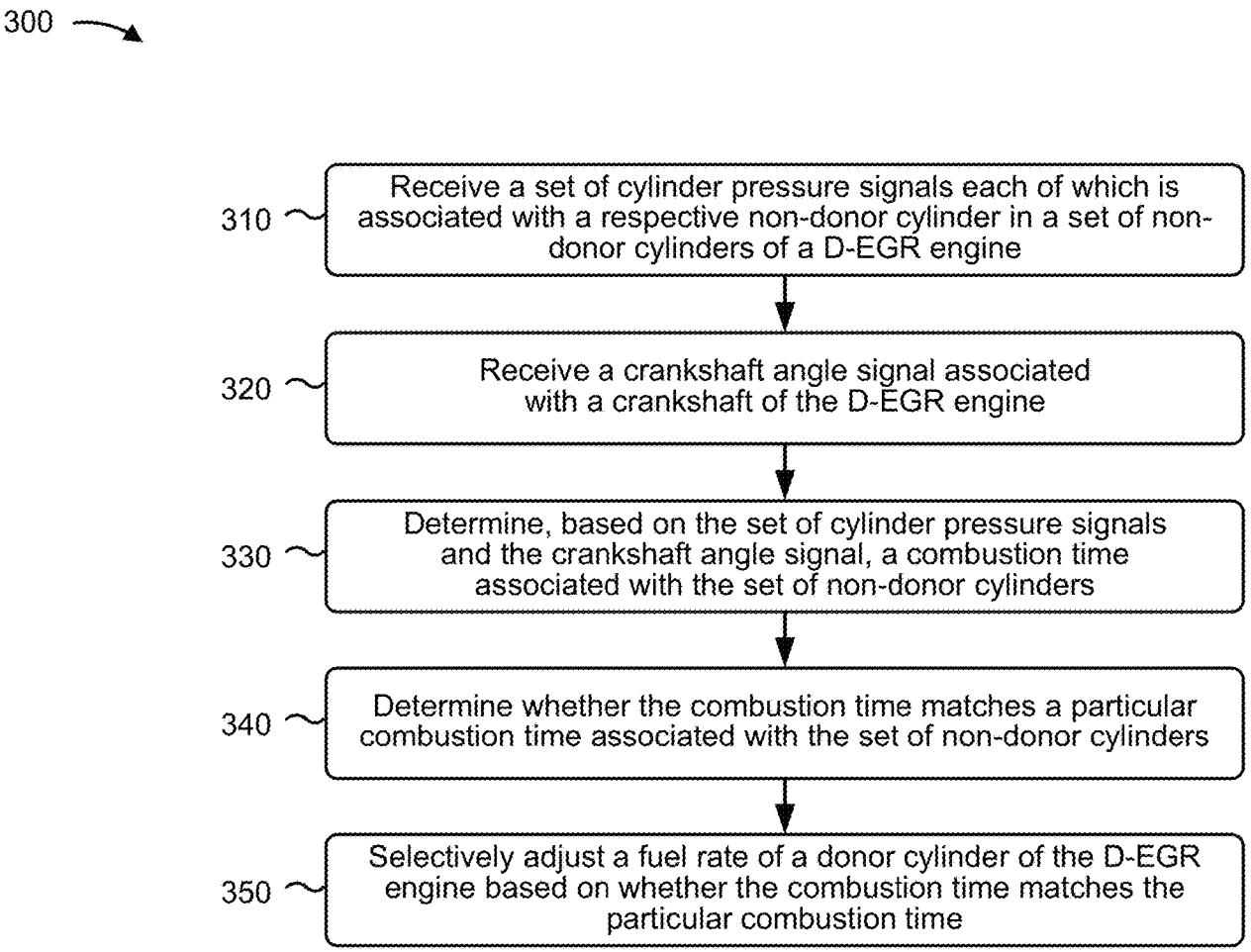
FIG. 3 is a flow chart of an example process for controlling a fuel rate of one or more donor cylinders of a D-EGR engine, as described herein.

FIG. 3 is a flow chart of an example process 300 for controlling a fuel rate of one or more donor cylinders of a D-EGR engine, as described herein. One or more process blocks of FIG. 3 may be performed by a device associated with an engine, such as control device 150 associated with D-EGR engine 101.

As shown in FIG. 3, process 300 may include receiving a set of cylinder pressure signals, each of which is associated with a respective non-donor cylinder in a set of non-donor cylinders of a D-EGR engine (block 310). For example, control device 150 may (e.g., using a processor, an input component, a communication interface, and/or the like) receive a set of cylinder pressure signals, each of which is associated with a respective non-donor cylinder 104 in a set of non-donor cylinders 104 of D-EGR engine 101.

Control device 150 may receive each of the set of cylinder pressure signals from a respective pressure sensor 134. For example, control device 150 may receive a first cylinder pressure signal from pressure sensor 134*a* associated with non-donor cylinder 104*a*, a second cylinder pressure signal from pressure sensor 134*b* associated with non-donor cylinder 104*b*, and a third cylinder pressure signal from pressure sensor 134*c* associated with non-donor cylinder 104*c*. Notably, the set of cylinder pressure signals need not include a cylinder pressure signal associated with donor cylinder 106 (e.g., since adjustment of the fuel rate of donor cylinder 106 is based on cylinder pressures associated with non-donor cylinders 104, as described below).

Control device 150 may receive the set of cylinder pressure signals based on requesting the cylinder pressure signal from the set of pressure sensors 134. Additionally, or alternatively, control device 150 may automatically receive the set of cylinder pressure signals from the set of pressure sensors 134 (e.g., when each of the set of pressure sensors 134 is configured to automatically provide a respective cylinder pressure signal on a periodic basis or continuously).

As further shown in FIG. 3, process 300 may include receiving a crankshaft angle signal associated with a crankshaft of the D-EGR engine (block 320). For example, control device 150 may (e.g., using a processor, an input component, a communication interface, and/or the like) receive a crankshaft angle signal associated with crankshaft 109 of D-EGR engine 101.

Control device 150 may receive the crankshaft angle signal from angle sensor 136 associated with crankshaft 109. Control device 150 may receive the crankshaft angle signal based on requesting the crankshaft angle signal from angle sensor 136. Additionally, or alternatively, control device 150 may automatically receive the crankshaft angle signal from angle sensor 136 (e.g., when angle sensor 136 is configured to automatically provide the crankshaft angle signal on a periodic basis or continuously).

As further shown in FIG. 3, process 300 may include determining, based on the set of cylinder pressure signals and the crankshaft angle signal, a combustion time associated with the set of non-donor cylinders (block 330). For example, control device 150 may (e.g., using a processor, a memory, and/or the like) determine, based on the set of cylinder pressure signals and the crankshaft angle signal, a combustion time associated with the set of non-donor cylinders 104.

A combustion time for a given non-donor cylinder 104 may be defined as an amount of time from a time of a first particular amount of fuel burn in non-donor cylinder 104 and a second particular amount of fuel burn in the non-donor cylinder 104. For example, the time of the first particular amount of fuel burn may be a time of approximately 10% fuel burn in the cylinder, and the time of the second particular fuel burn may be a time of approximately 90% of fuel burn in the cylinder. Here, the combustion time is an amount of time from the time of 10% fuel burn in non-donor cylinder 104 and the time of 90% fuel burn in non-donor cylinder 104. Other particular amounts of fuel burn may be used, for example, the time of the first particular amount of fuel burn may be a time of approximately 20% fuel burn in the cylinder, and the time of the second particular fuel burn may be a time of approximately 80% of fuel burn in the cylinder.

Control device 150 may determine the combustion time for a given non-donor cylinder 104 by calculating a heat release rate (e.g., an AHRR) from a cylinder pressure signal, associated with the given non-donor cylinder 104, and the crankshaft angle signal (using techniques known in the art). Control device 150 may then identify, based on the heat release rate, a first angular position of crankshaft 109 at the time of the first particular amount of fuel burn and a second angular position of crankshaft 109 at the time of the second amount of fuel burn. Control device 150 may compute the combustion time as an amount of time between a time point associated with the first angular position and a time point associated with the second angular position (i.e., an amount of time from a time at which crankshaft 109 was in the first angular position to a time at which crankshaft 109 was in the second angular position).

For example, for a given non-donor cylinder 104, control device 150 may calculate an AHRR based on an associated cylinder pressure signal and the crankshaft angle signal. Next, control device 150 may identify, based on the AHRR, an angular position of crankshaft 109 at a time of 10% fuel burn (i.e., CA10) in the given non-donor cylinder 104 and an angular position of crankshaft 109 at a time of 90% fuel burn (i.e., CA90) in the given non-donor cylinder 104. Control device 150 may then compute, based on the crankshaft angle signal, the combustion time of the given non-donor cylinder 104 as an amount of time between a time of CA10 and a time of CA90 associated with the non-donor cylinder 104.

Control device 150 may determine a single combustion time, associated with a particular non-donor cylinder 104, and may selectively adjust the fuel rate of one or more donor cylinders 106 based on the combustion time associated with the particular non-donor cylinder 104 in the manner described below. Alternatively, control device 150 may determine multiple combustion times, each of which corresponds to a respective non-donor cylinder 104. In such a case, control device 150 may determine an average combustion time based on the multiple of combustion times, and may selectively adjust the fuel rate of one or more donor cylinders 106 based on the average combustion time in the manner described below. In other words, the combustion time based on which the fuel rate of one or more donor cylinders 106 is selectively adjusted may be based on a combustion time of a single non-donor cylinder 104 or combustion times of multiple non-donor cylinders 104.

As further shown in FIG. 3, process 300 may include determining whether the combustion time matches a particular combustion time associated with the set of non-donor cylinders (block 340). For example, control device may (e.g., using a processor, a memory, and/or the like) determine whether the combustion time matches a particular combustion time associated with the set of non-donor cylinders 104.

The particular combustion time may be an expected, desired, or preferred combustion time of a given non-donor cylinder 104. For example, the particular combustion time may be a desired average combustion time for the set of non-donor cylinders 104 of D-EGR engine 101. Additionally, or alternatively, the particular combustion time may depend on an engine speed and/or an engine load of D-EGR engine 101.

Control device 150 may determine information that identifies the particular combustion time based on information stored or accessible by control device 150. For example, control device 150 may store a lookup table that includes information that identifies a particular combustion time for one or more non-donor cylinders 104 (e.g., for a given range of engine speeds and/or range of engine loads).

Control device 150 may determine whether the combustion time matches the particular combustion time based on a difference between the combustion time and the particular combustion time. For example, control device 150 may calculate a difference between the combustion time (e.g., a combustion time associated with a single non-donor cylinder 104, an average combustion time associated with multiple non-donor cylinders 104) and a desired combustion time, and may determine whether the difference satisfies a threshold. Here, if the difference satisfies the threshold (e.g., if the difference is less than or equal to a maximum allowable difference), then control device 150 may determine that the combustion time matches the desired combustion time. Alternatively, if the difference does not satisfy the threshold (e.g., if the difference is greater than the maximum allowable difference), then control device 150 may determine that the combustion time does not match the desired combustion time.

As further shown in FIG. 3, process 300 may include selectively adjusting a fuel rate of a donor cylinder of the D-EGR engine based on whether the combustion time matches the particular combustion time (block 350). For example, control device 150 may (e.g., using a processor, a memory, an output component, a communication interface, and/or the like) selectively adjust a fuel rate of donor cylinder 106 of D-EGR engine 101 based on whether the combustion time matches the particular combustion time.

When control device 150 determines that the combustion time does not match the particular combustion time, control device 150 may determine whether the combustion time is shorter than the particular combustion time or longer than the particular combustion time. For example, control device 150 may determine that the average combustion time does not match a desired average combustion time, as described above. Here, control device 150 may determine whether the average combustion time is longer than the desired combustion time or shorter than the combustion time.

When control device 150 determines that the combustion time is longer than the desired combustion time, control device 150 may increase the fuel rate of donor cylinder 106. Increasing the fuel rate of donor cylinder 106 causes donor cylinder 106 to run comparatively richer, which causes exhaust gas of donor cylinder 106 to produce comparatively more hydrogen. The exhaust gas of donor cylinder 106 is recirculated (e.g., to all cylinders of D-EGR engine 101), and the greater amount of hydrogen increases a flame speed of a given cylinder, thereby decreasing the combustion duration of a given cylinder. Conversely, When control device 150 determines that the combustion time is shorter than the desired combustion time, control device 150 may decrease the fuel rate of donor cylinder 106. Decreasing the fuel rate of donor cylinder 106 causes donor cylinder 106 to run comparatively leaner, which causes exhaust gas of donor cylinder 106 to produce comparatively less hydrogen. The exhaust gas of donor cylinder 106 is recirculated (e.g., to all cylinders of D-EGR engine 101), and the lesser amount of hydrogen decreases a flame speed of a given cylinder, thereby increasing the combustion duration of a given cylinder.

Control device 150 may adjust (e.g., increase or decrease) the fuel rate of donor cylinders 106 by sending a control signal to fuel injector **108*d* associated with donor cylinder 106. Control device 150** may adjust the fuel rate by an incremental amount, by a default amount, or by an amount determined based on the difference between the combustion time and the desired combustion time (e.g., based on a lookup table that identifies fuel rate adjustments for differences between the combustion time and the particular combustion time).

When control device 150 determines that the combustion time matches the particular combustion time, the selective adjustment by control device 150 may include maintaining the fuel rate of donor cylinder 106 (e.g., such that the fuel rate of donor cylinder 106 is not adjusted). In this way, control device 150 may control a fuel rate of a donor cylinder (e.g., donor cylinder 106 of a D-EGR engine (e.g., D-EGR engine 101) based on cylinder pressure within one or more non-donor cylinders (e.g., non-donor cylinders 104) of the D-EGR engine.

Although FIG. 3 shows example blocks of process 300, process 300 may include additional blocks, fewer blocks, different blocks, or differently arranged blocks than those depicted in FIG. 3. Additionally, or alternatively, two or more of the blocks of process 300 may be performed in parallel.

INDUSTRIAL APPLICABILITY

The disclosed engine system (e.g., engine system 100) and the disclosed controller (e.g., control device 150) may be used in association with controlling ignition timing of a cylinder (e.g., non-donor cylinder 104 or donor cylinder 106) of a D-EGR engine (e.g., D-EGR engine 101). Control of the ignition timing of a given cylinder may be performed based on determining whether an angular position of a crankshaft (e.g., crankshaft 109) at a time of a particular amount of fuel burn (e.g., 50% fuel burn) in the cylinder matches a desired angular position of the crankshaft at the time of the particular amount of fuel burn. The time of the particular amount of fuel burn is determined based on a heat release rate computed from a cylinder pressure signal, associated with the cylinder, and a crankshaft angle signal associated with the crankshaft. Further, the disclosed engine system and the disclosed controller may be used in association with controlling a fuel rate of a donor cylinder (e.g., donor cylinder 106) of the D-EGR engine. Control of the fuel rate of the donor cylinder may be performed based on determining whether a combustion time, associated with one or more non-donor cylinders (e.g., a set of non-donor cylinders 104) matches a desired combustion time. The combustion time may be determined based on heat release rates computed from one or more cylinder pressure signals, associated with the one or more non-donor cylinders, and a crankshaft angle signal associated with the crankshaft.

The techniques for controlling cylinder ignition timing and donor-cylinder fuel rate, as described herein, can improve performance and/or efficiency of the D-EGR, thereby allowing benefits of the D-EGR engine to be achieved (e.g., reduced pollutants, reduced engine knock, reduced throttling losses, reduced in-cylinder heat losses, and/or the like) with increased performance and fuel efficiency.

As used herein, the articles "a" and "an" are intended to include one or more items, and may be used interchangeably with "one or more." Also, as used herein, the terms "has," "have," "having," or the like are intended to be open-ended terms. Further, the phrase "based on" is intended to mean "based, at least in part, on."

The foregoing disclosure provides illustration and description, but is not intended to be exhaustive or to limit the implementations to the precise form disclosed. Modifications and variations may be made in light of the above disclosure or may be acquired from practice of the implementations. It is intended that the specification be considered as an example only, with a true scope of the disclosure being indicated by the following claims and their equivalents. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

What is claimed is:

1. A method, comprising:

receiving, by a device, a cylinder pressure signal associated with a cylinder in a dedicated exhaust gas recirculation (D-EGR) engine;

determining, by the device and based on the cylinder pressure signal a combustion time;

determining, by the device, whether the combustion time matches a particular combustion time; and selectively adjusting, by the device, a fuel rate of the cylinder based on whether the combustion time matches a particular combustion time, wherein, when the combustion time does not match the particular combustion time, selectively adjusting the fuel rate of the cylinder comprises:

increasing the fuel rate of the cylinder when the combustion time is longer than the particular combustion time, or decreasing the fuel rate of the cylinder when the combustion time is shorter than the particular combustion time.

2. The method of claim 1, wherein the cylinder is a donor cylinder of the D-EGR engine.

3. The method of claim 1, wherein the combustion time is associated with a non-donor cylinder of the D-EGR engine.

4. The method of claim 1, further comprising:

determining, based on the cylinder pressure signal, an angular position of a crankshaft, of the D-EGR engine, at a time of a particular amount of fuel burn in the cylinder;

determining whether a difference between the angular position and a particular angular position satisfies a threshold, wherein the particular angular position is an expected, desired, or preferred angular position of the crankshaft at the time of the particular amount of fuel burn in the cylinder;

determining whether the angular position matches the particular angular position based on whether the difference satisfies the threshold; and selectively adjusting ignition timing of the cylinder based on whether the angular position matches the particular angular position.

5. The method of claim 4, wherein, when the angular position does not match the particular angular position, selectively adjusting the ignition timing of the cylinder comprises:

advancing the ignition timing of the cylinder when the angular position is after the particular angular position; or retarding the ignition timing of the cylinder when the angular position is before the particular angular position.

6. The method of claim 4, wherein, when the angular position matches the particular angular position, selectively adjusting the ignition timing of the cylinder comprises maintaining the ignition timing of the cylinder.

7. A method, comprising:

receiving, by a device, a set of cylinder pressure signals, each of which is associated with a respective non-donor cylinder in a set of non-donor cylinders of a dedicated exhaust gas recirculation (D-EGR) engine;

receiving, by the device, a crankshaft angle signal associated with a crankshaft of the D-EGR engine;

determining, by the device and based on the set of cylinder pressure signals and the crankshaft angle signal, a combustion time associated with the set of non-donor cylinders;

determining, by the device, whether the combustion time matches a particular combustion time associated with the set of non-donor cylinders; and selectively adjusting, by the device, a fuel rate of a donor cylinder of the D-EGR engine based on whether the combustion time matches the particular combustion time, wherein, when the combustion time does not match the particular combustion time, selectively adjusting the fuel rate of the donor cylinder comprises:

increasing the fuel rate of the donor cylinder when the combustion time is longer than the particular combustion time, or decreasing the fuel rate of the donor cylinder when the combustion time is shorter than the particular combustion time.

8. The method of claim 7, wherein the combustion time is an average of a set of combustion times each of which corresponds to a respective one of the set of non-donor cylinders.

9. The method of claim 7, wherein the combustion time is determined based on a set of angular positions at times of approximately 10% fuel burn in the set of non-donor cylinders and a set of angular positions at times of approximately 90% fuel burn in the set of non-donor cylinders.

10. The method of claim 7, further comprising:

determining whether a difference between the combustion time and the particular combustion time satisfies a threshold; and wherein determining whether the combustion time matches the particular combustion time comprises:

determining whether the combustion time matches the particular combustion time based on whether the difference between the combustion time and the particular combustion time satisfies the threshold.

11. The method of claim 7, wherein, when the combustion time matches the particular combustion time, selectively adjusting the fuel rate of the donor cylinder comprises maintaining the fuel rate of the donor cylinder.

12. An engine system, comprising:

a dedicated exhaust gas recirculation (D-EGR) engine; and a controller, communicatively coupled with the D-EGR engine, to:

receive a plurality of cylinder pressure signals associated with a plurality of cylinders of the D-EGR engine;

receive a crankshaft angle signal associated with a crankshaft of the D-EGR engine;

determine a combustion time based on the crankshaft angle signal and one or more of the plurality of cylinder pressure signals;

determine whether the combustion time matches a particular combustion time; and selectively adjust a fuel rate based on whether the combustion time matches the particular combustion time, wherein, when the combustion time does not match the particular combustion time, the controller, when selectively adjusting the fuel rate, is to:

increase the fuel rate when the combustion time is longer than the particular combustion time; or decrease the fuel rate when the combustion time is shorter the particular combustion time.

13. The engine system of claim 12, wherein the controller is further to:

determine, based on a cylinder pressure signal, of the set of cylinder pressure signals, and the crankshaft angle signal, an angular position of the crankshaft at a time of a particular amount of fuel burn in a cylinder of the plurality of cylinders;

determine whether the angular position matches a particular angular position of the crankshaft at the time of the particular amount of fuel burn in the cylinder; and selectively adjust an ignition timing of the cylinder based on whether the angular position matches the particular angular position.

14. The engine system of claim 13, wherein, when the angular position does not match the particular angular position, the controller, when selectively adjusting the ignition timing of the cylinder, is to:

advance the ignition timing of the cylinder when the angular position is after the particular angular position; or retard the ignition timing of the cylinder when the angular position is before the particular angular position.

15. The engine system of claim 13, wherein, when the angular position matches the particular angular position, the controller, when selectively adjusting the ignition timing of the cylinder, is to maintain the ignition timing of the cylinder.

16. The engine system of claim 12, wherein, when the combustion time matches the particular combustion time, the controller, when selectively adjusting the fuel rate, is to maintain the fuel rate.

17. The engine system of claim 12, wherein the plurality of cylinders include at least one donor cylinder and a set of non-donor cylinders.

18. The engine system of claim 12, wherein the fuel rate is a fuel rate of at least one donor cylinder of the plurality of cylinders.

19. The engine system of claim 12, wherein the combustion time is associated with a set of non-donor cylinders of the plurality of cylinders.

20. The engine system of claim 12, wherein the particular combustion time is an expected, desired, or preferred combustion time of a non-donor cylinder of the plurality of cylinders.

* * * * *